US009834954B2

(12) United States Patent
Becher et al.

(10) Patent No.: US 9,834,954 B2
(45) Date of Patent: Dec. 5, 2017

(54) FOLDABLE MODULAR STRUCTURE FOR A FAST-ERECTING TENT OR SIMILAR SHELTER

(71) Applicants: BECHER STP, Grostenquin (FR); INNOVATION FOR SHELTER INTERNATIONAL, Ehlerange (LU)

(72) Inventors: Benoit Becher, Grostenquin (FR); Regis Gherardini, Volstroff (FR); Olivier Meyer, Rozerieulles (FR); Christophe Ewoldt, Freybouse (FR); Remy Woh, Bistroff (FR); Thierry Streiff, Gros-Rederching (FR)

(73) Assignees: Becher STP, Grostenquin (FR); Innovation For Shelter International, Ehlerange (LU)

( * ) Notice: Subject to any disclaimer, the term of this patent is extended or adjusted under 35 U.S.C. 154(b) by 0 days.

(21) Appl. No.: 14/891,983

(22) PCT Filed: Nov. 18, 2014

(86) PCT No.: PCT/FR2014/052944
§ 371 (c)(1),
(2) Date: Nov. 18, 2015

(87) PCT Pub. No.: WO2015/075367
PCT Pub. Date: May 28, 2015

(65) Prior Publication Data

US 2016/0265246 A1 Sep. 15, 2016

(30) Foreign Application Priority Data

Nov. 21, 2013 (FR) ..... 13 61475

(51) Int. Cl.
*E04H 15/46* (2006.01)
*E04H 15/48* (2006.01)
*E04H 15/40* (2006.01)

(52) U.S. Cl.
CPC ..... *E04H 15/46* (2013.01); *E04H 15/405* (2013.01); *E04H 15/48* (2013.01)

(58) Field of Classification Search
CPC ..... E04H 15/48; E04H 15/34; E04H 15/46; E04H 15/36; E04H 15/405
(Continued)

(56) References Cited

U.S. PATENT DOCUMENTS 1,504,889 A * 8/1924 Hansen ..... E04H 15/48 135/153
2,151,908 A * 3/1939 Gottlieb ..... E04B 1/3441 135/117
(Continued)

FOREIGN PATENT DOCUMENTS

EP 1493886 A1 1/2005
EP 1914364 A2 4/2008
(Continued)

*Primary Examiner* — Winnie Yip
(74) *Attorney, Agent, or Firm* — Bachman & LaPointe, P.C.

(57) ABSTRACT

A foldable modular structure for a fast-erecting shelter comprising the assembly of profiled sections that form at least two opposing arches linked by at least two purlins, including one ridge purlin. A first end of the ridge purlin is linked by a hinge to a first ridge part of a first arch, said hinge comprising first pivoting means allowing said ridge purlin to pivot on a transverse axis, parallel to the plane of the arch, in order to allow the purlin to fold parallel to said arch, and second pivoting means allowing the ridge purlin to pivot on an axis perpendicular to the plane of the arch, and the second end of the ridge purlin comprises linking means for linking with a second ridge part of a second arch, said linking means
(Continued)

being arranged to provide a dismountable but rigid link between the ridge purlin and said second linking part.

13 Claims, 4 Drawing Sheets

(58) Field of Classification Search
USPC ..... 135/121–124, 120.1, 120.3, 136, 135/138–140, 143–144, 151–154; 52/83, 52/64–646, 656.9, 4; 403/83, 93, 97–98, 403/170
See application file for complete search history.

(56) References Cited

U.S. PATENT DOCUMENTS 2,182,283 A * 12/1939 Curtis ..... E04H 15/48 135/117
3,604,439 A * 9/1971 Thomka ..... E04H 15/36 135/120.3
4,066,089 A * 1/1978 Rainwater ..... E04H 15/48 135/114
4,347,690 A * 9/1982 Wallace, Jr. ..... E04B 1/34326 135/160
5,069,238 A * 12/1991 Marks ..... E04H 15/48 135/153
5,167,246 A * 12/1992 Mortenson ..... E04H 15/48 135/143
5,263,507 A 11/1993 Chuang
5,771,651 A * 6/1998 Shiina ..... E04H 15/48 135/143
7,290,553 B2 11/2007 Prevost
7,584,763 B2 * 9/2009 Yoon ..... E04H 15/52 135/131
8,820,340 B2 * 9/2014 Hughes ..... E04H 15/50 135/131
9,097,034 B2 * 8/2015 Hotes ..... E04H 15/48
2011/0284044 A1 11/2011 Baldussi
2013/0192653 A1 * 8/2013 Watson ..... E04H 15/48 135/139

FOREIGN PATENT DOCUMENTS

EP 2385191 A1 11/2011
GB 2475512 A 5/2011

* cited by examiner

FOLDABLE MODULAR STRUCTURE FOR A FAST-ERECTING TENT OR SIMILAR SHELTER

BACKGROUND

This invention concerns a foldable modular structure for a fast-erecting tent or similar shelter.

The invention relates particularly to tents designed for emergency situations and military use. In this particular type of application, it is required that tents have a relatively small volume when they are disassembled, and that they can be erected and deployed quickly whilst providing shelter capable of resisting harsh weather conditions.

Generally a tent consists of a structure supporting a canvas, said structure being dismountable, and consisting to this effect of a frame assembled by slotting together tubular sections, which may be articulated with each other.

Structures are already known that comprise a succession of parallel roof poles forming trusses, linked two by two by connecting bars notably constituting purlins. These connecting bars are slotted together with said roof poles, and to enable the roof poles to be moved closer together and/or apart, these bars be formed of two profiled section members articulated with each other and lockable lengthwise to form a rigid bar or purlin.

With EP1493886 in particular, a rapidly erectable, modular and foldable structure for tents is known, which consists of an assembly of tubular sections, enabling in particular at least two opposing arches to be formed, linked by at least two purlins, including one ridge purlin. Said ridge purlin in this case consists of the abutment of two profiled sections, each fastened, moreover, at the other end to a ridge part on each of said arches, said end comprising, firstly, pivoting means enabling it to pivot on said ridge part around an axis perpendicular to the plane of the arch, whilst indexing means angularly limit said pivoting and, secondly, pivoting means enable the rotation of said end around a transverse axis parallel to the plane of the arch, in order to enable said profiled section to fold parallel to said arch. The abutment of the two profiled sections of the ridge purlin is achieved by interlocking means capable of immobilising the axial rotation of one section in relation to the other according to the angular positions of the latter defined by said indexing means. Due to the limiting of the rotation around an axis perpendicular to the plane of the arches, of each of the sections in relation to the respective arches with which they are linked, and due to the immobilising of the pivoting in relation of the two sections when erecting the structure, such a structure makes it possible to maintain the ridge purlin formed by the assembly of the two sections in a fixed position.

This system is satisfactory, although it requires relatively precise indexing means to ensure good immobilisation of the pivoting of the ridge purlin without interfering with the abutting operations when erecting the structure.

SUMMARY

The purpose of this invention is to solve the problems mentioned above, and it aims in particular to propose a foldable modular structure that is simpler and more robust in design than earlier systems.

With these aims in mind, the invention concerns a foldable modular structure for a fast-erecting tent or similar shelter, consisting of the assembly of profiled sections, generally of the tubular type, intended to support a canvas, said profiled sections forming, in particular, at least two opposing arches linked by at least two purlins, including one ridge purlin.

According to the invention, the structure is characterised in that a first end of said ridge purlin is linked by a hinge to a first ridge part on a first of said arches, said hinge comprising, on the one hand, first pivoting means allowing said ridge purlin to pivot according to a transverse axis, parallel to the plane of the arch, in order to allow the purlin to fold parallel to said arch, and on the other hand, second pivoting means allowing the ridge purlin to pivot according to an axis perpendicular to the plane of the arch, and the second end of the ridge purlin comprises linking means for linking with a second ridge part on the second of said arches, said linking means being arranged to provide a dismountable but rigid link between the ridge purlin and said second linking part.

By a dismountable but rigid link, it is understood here a link immobilising the ridge purlin on the second linking part when the structure is erected and in use, but separable during the disassembly operations during routine use of the structure, that is to say when the tent is dismantled, and that with no need for any tools.

Thus, when the structure is folded away for transport, the ridge purlin can, thanks to the dual-pivoting joint means at its first end which form a sort of swivel joint, be folded against a profiled section forming the first arch. And, when the structure is deployed, the dismountable rigid link of the second end of the ridge purlin to the second arch is capable of immobilising the ridge purlin pivoting with respect to the arches, according to a longitudinal axis of said ridge purlin. Thereby the distance between the arches is maintained, whilst the dismountable rigid link also guarantees the optimum positioning of the ridge purlin to provide the best mechanical flexural strength under the loads to which it is subjected when the tent is in use.

Typically, the ridge purlin has a generally elongated rectangular cross section, and the ridge purlin will therefore be immobilised in rotation in a position where its cross section extends vertically, offering the best mechanical resistance to vertical loads.

According to a preferred embodiment, the ridge purlin is telescopic, making it possible to reduce its length in order to place it, when in the retracted position, against one of the rafters constituting the arch, without exceeding the length of that rafter. It will be noted incidentally that, to make the structure more compact when it is folded away, whilst still allowing for large dimensions when it is deployed, said rafters may also be telescopic. When the structure is deployed, the ridge purlin is extended so that its length corresponds to the distance between the arches, which is, moreover, determined by the length of the other purlins, as will be seen below.

So that the ridge purlin is telescopic as indicated above, it comprises, preferentially, two tubular sections sliding one inside the other, and locking means are provided to lock said sliding sections one onto the other. These locking means may typically be pin-type locking devices, according to a principle that is well known elsewhere, resiliently mounted to be retractable into the inner section and able to engage, when the telescopic purlin is extended, in a hole in the outer section, thereby locking the two sections in position.

According to another particular embodiment, the hinge connecting the ridge purlin to the first ridge part comprises a clevis, integral with the end of the ridge purlin, pivotably mounted on an intermediate swivel pin according to an axis parallel to the plane of the arch, the intermediate swivel pin being pivotably mounted on the first ridge part according to an axis perpendicular to the plane of the arch. This embodiment achieves the two pivoting movements required of the ridge purlin in relation to the first arch in a simple way.

According to another particular embodiment, the linking means linking the ridge purlin to the second ridge part comprise a fixed bush linked rigidly to the second ridge part and having a vertical axis, and a lug, integral with the second end of the ridge purlin, extending perpendicular to the longitudinal direction of the ridge purlin and in the longitudinal direction of the cross section of the latter, and arranged to engage slidingly downwards into said bush.

When the structure is deployed, this lug is simply inserted into said bush to achieve at once the linking of the two arches and the immobilization of the pivoting of the ridge purlin around its own longitudinal axis. The weight of the ridge purlin and the tent canvas supported by the latter is sufficient to hold the lug in place in the bush.

According to yet another particular embodiment, each of the arches consists of a ridge part and two rafters, preferentially telescopic, attached to said ridge part according to separated axes perpendicular to the plane of the arch, the pivoting of the rafters being limited by stops provided in said ridge part. These embodiments allow the rafters to be folded one against the other when folding away the structure, thereby ensuring the compactness of the folded structure.

Also preferentially, the ridge parts comprise means of centering them one with the other in order to maintain them in their relative position when the structure is folded away, which maintains the ridge parts and the rafters in their relative positions as long as the structure is not deployed.

The secondary purlin or purlins that link the two arches together in addition to the ridge purlin, preferentially consist of two profiled sections pivotably attached on one hand to each other and also to their respective arches, according to parallel axes of rotation, so as to allow one of said sections to be folded onto the other, thereby bringing together two neighbouring arches. The axes of rotation of the profiled sections are perpendicular to the general direction of the rafters forming the arches, so that said sections can be folded against the rafters and parallel to them.

The joint linking the two profiled sections forming a purlin comprises blocking means allowing the two sections to kept aligned after deployment, said blocking means comprising, preferentially, a tubular latch arranged to slide over said sections and to be able to cover the joint and the ends of the two sections adjacent to said joint, thereby immobilising said sections in aligned respective position.

Other features and advantages will appear in the description that follows of a foldable modular structure for a fast-erecting tent according to the invention.

BRIEF DESCRIPTION OF THE DRAWINGS

Referring to the drawings enclosed.

DETAILED DESCRIPTION

Figure 1:
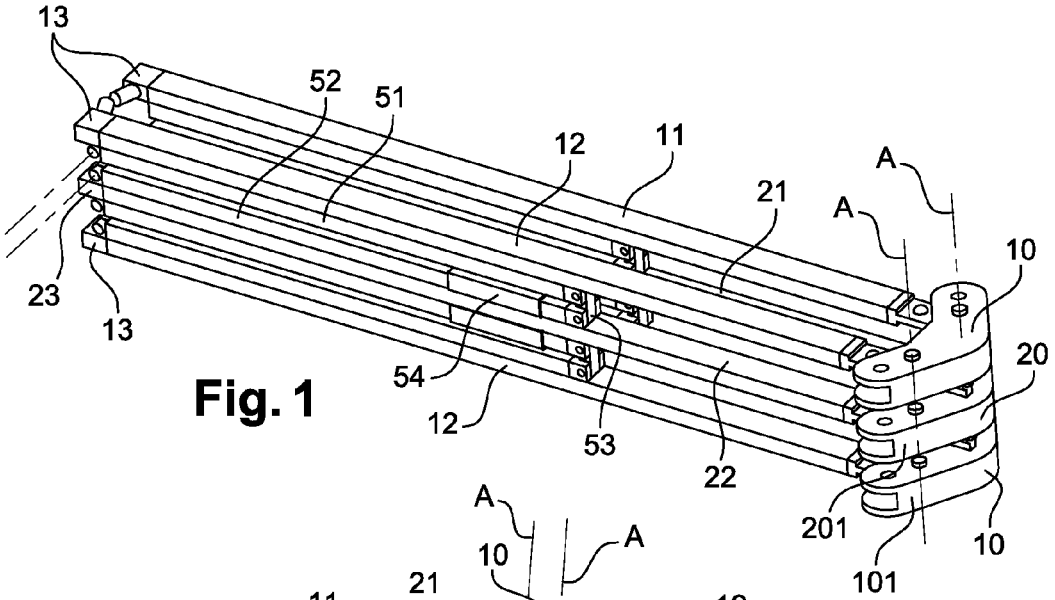
FIG. 1 is a perspective view of the structure according to the invention, in the transport position, prior to any deployment.

The structure according to the invention illustrated in the different drawings comprises three arches: two end arches 1 and a central arch 2, each in the shape of an inverted V and consisting of a ridge part 10, 20, onto which are attached, pivoting according to axes of rotation A perpendicular to the plane of the arch, two rafters, 11 and 12, and 21 and 22, respectively. The pivoting of the rafters on the ridge parts is limited by stops 101, 201 provided on said ridge parts so as to achieve the desired angle of the V formed by the rafters.

Each rafter comprises at its opposite end to the ridge part, an angle part 13, 23 arranged to connect firstly the legs 3, and secondly, the eave purlins.

Arches 1 and 2 are connected by three purlins, one ridge purlin 4 which extends between the two ridge parts 10, 20 of the neighbouring arches 1, 2, and two eave purlins 5 which are also connected pivotably with the angle parts 13, 23.

Figure 3:
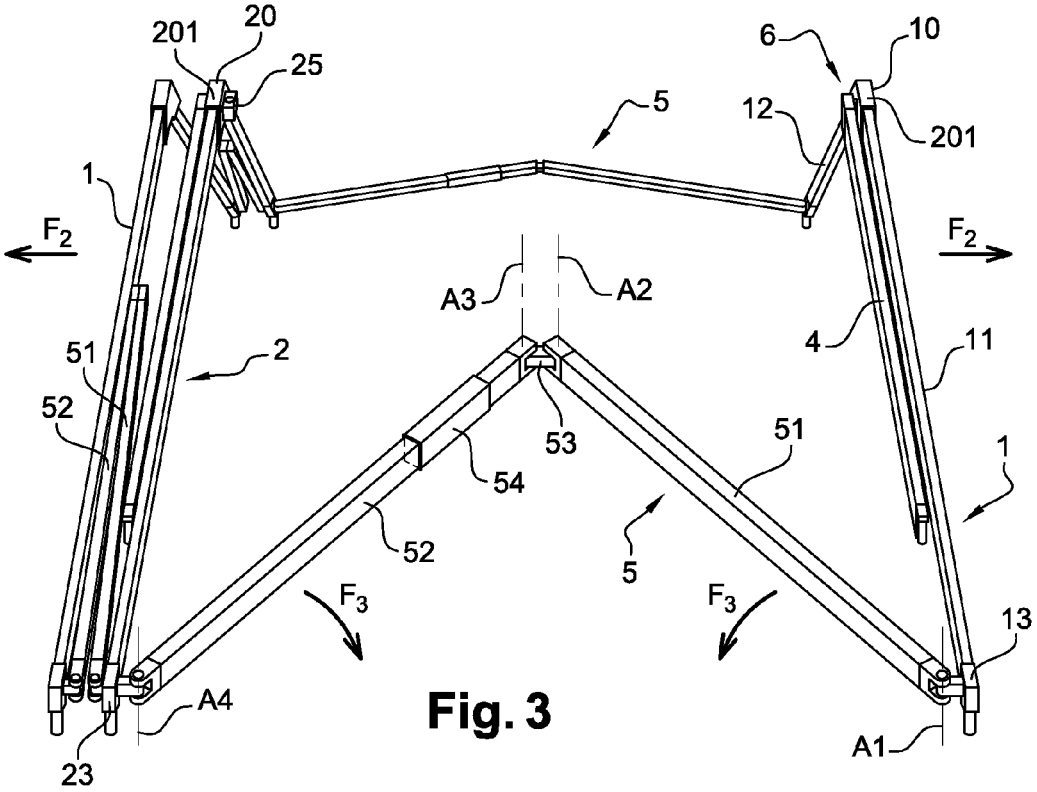
FIG. 3 shows the next stage of erection, with the deployment of the eave purlins.
Figure 4:
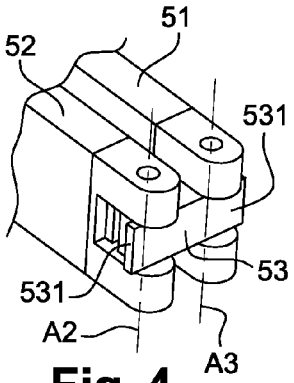
FIGS. 4 and 5 show in detail the hinge of the profiled sections constituting said eave purlins, in the folded and deployed positions respectively.
Figure 5:
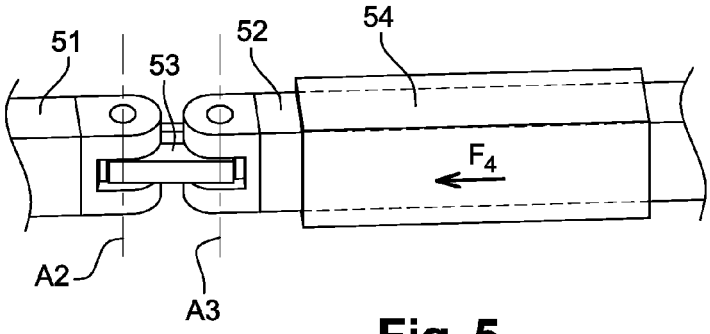
Figure 6:
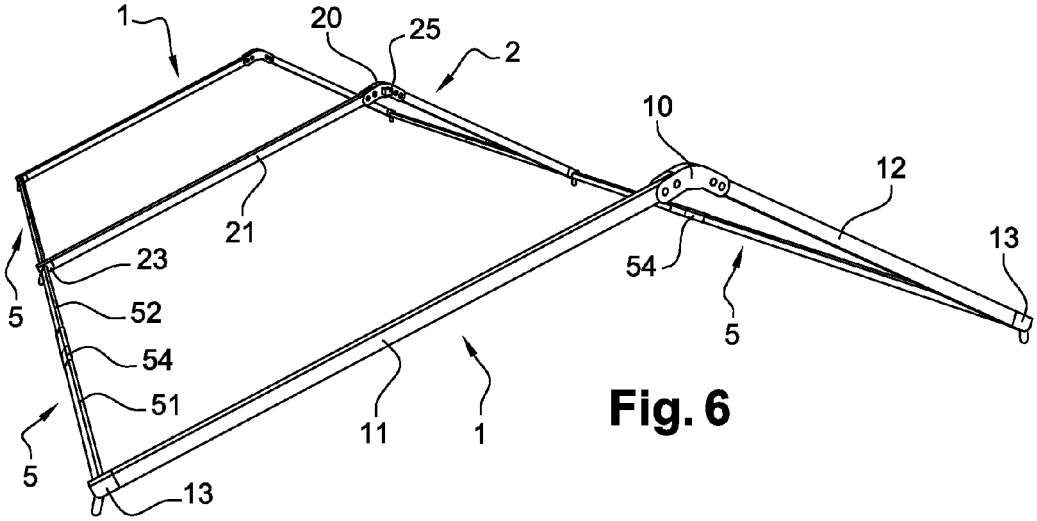
FIG. 6 shows the structure after complete deployment of the eave purlins, before deploying the ridge purlin.
Figure 7:
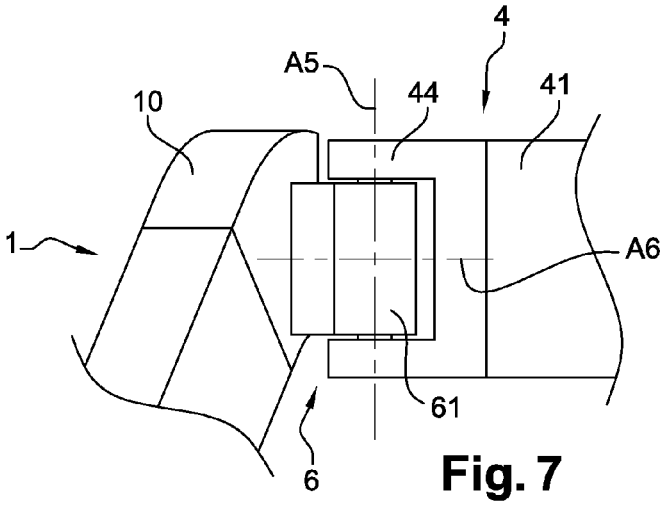
FIG. 7 shows in detail the link between the ridge purlin and the first ridge part.
Figure 8:
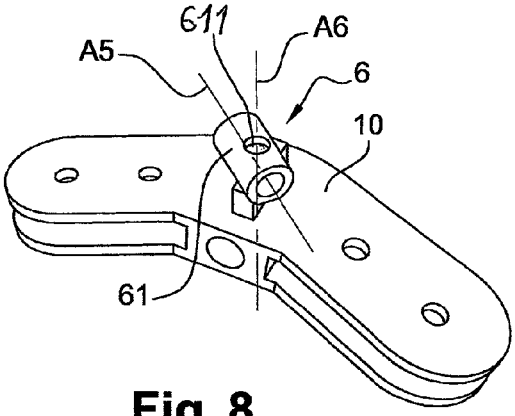
FIG. 8 is a view of the first ridge part on its own.
Figure 9:
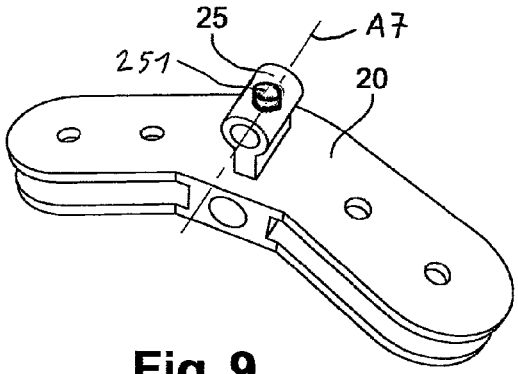
FIG. 9 is a view of the second ridge part on its own.
Figure 10:
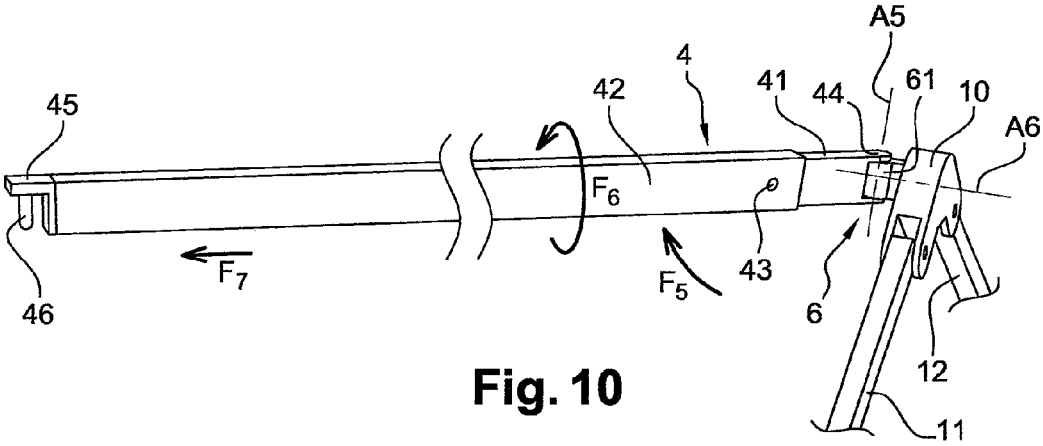
FIG. 10 illustrates the beginning of the deployment of the ridge purlin.

The eave purlins 5 consist of two profiled sections 51, 52 pivotably attached, on the one hand, to each other, and on the other hand to their respective arches 1, 2, according to parallel axes of rotation A1 to A4, as can be seen in FIG. 3, so as to allow said sections 51, 52 to be folded one over the other and therefore two neighbouring arches to be moved closer together or apart. The profiled sections 51, 52 are attached to each other by means of a linking part 53, which can be seen better in FIGS. 4 and 5. This linking part 53, onto which the profiled sections 51, 52 are pivotably mounted according to axes A2, A3, parallel to and distant from each other so as to allow the sections to be folded parallel one against the other, also comprises two stops 531 arranged to limit the relative pivoting of the sections in the direction of moving them apart, at a position in which the two sections are in alignment, as shown in FIG. 5. A latch 54, in the form of a tubular member slidingly mounted with a simple functional clearance onto one of the sections, can then be slid into a position where it covers the articulation area including the ends of the two sections 51, 52 and the linking part 53, and can be immobilised in translation, thereby blocking the two sections in an aligned position, as can be seen in FIG. 6 in particular.

Figure 2:
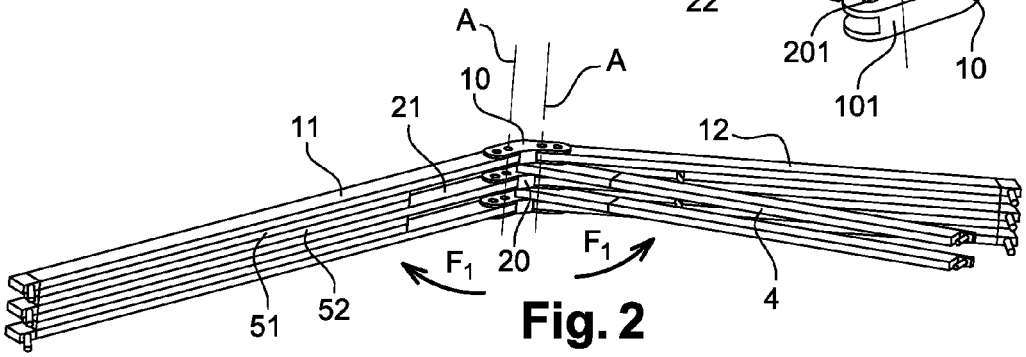
FIG. 2 shows the first phase of erection, with the deployment of the rafters forming the arches.

It will also be noted that the axes of rotation A1 and A4 of the two profiled sections on the angle parts 13, 23 are orthogonal to the rafters 11, 12, 21, 22, so that, in the folded position, the sections are folded against said rafters, parallel to them, as shown in FIGS. 1 and 2.

The ridge purlin 4 consists of two profiled sections 41, 42 of generally rectangular cross section, sliding one inside the other so that the ridge purlin is telescopic; and it comprises means of locking the two sections 41, 42 both in the retracted position, to hold the ridge purlin in this retracted position when the structure is folded away, and in the extended position, when the purlin is connecting the two arches 1, 2. These locking means may in particular be pin-type locking devices 43, of a type already known for locking sliding telescopic members.

The ridge purlin 4 is fastened at one end onto a first arch, for example arch 1, by means of a concurrent axis hinge system 6 allowing first of all the ridge purlin 4 to pivot in relation to the arch 1 according to an axis A5 parallel to the plane of said arch, and according to an axis A6 orthogonal to said plane of the arch, which allows the ridge purlin to be brought against one of the rafters 11, 12 when the structure is folded away, and, alternatively, when the structure is deployed, to place said purlin 4 perpendicular to the plane of the arch 1, to connect the second arch 2 to it, the pivoting according to axis A6 allowing the ridge purlin 4 to be placed in the position where it offers the best resistance to the vertical loads, that is to say with its rectangular cross section, and therefore axis A5, oriented vertically. The hinge system 6 typically comprises a swivel pin 61 pivotably mounted according to axis A6 on the ridge part 10, and the end of the ridge purlin 4 comprises a clevis 44 pivotably mounted on said swivel pin according to axis A5.

Figure 11:
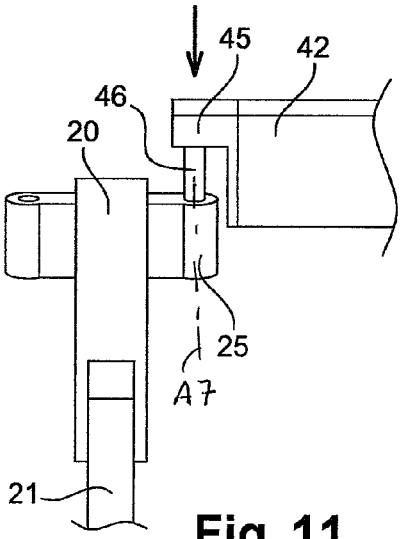
FIGS. 11 and 12 illustrate the connection of the ridge purlin onto the second arch.
Figure 12:
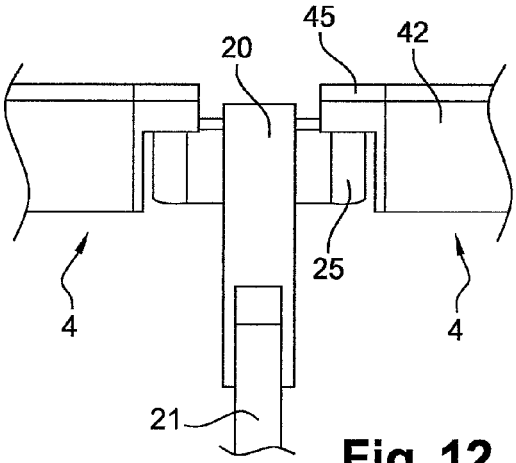

The ridge purlin 4 comprises at its other end a connecting piece 45 comprising a lug 46 which extends perpendicular to the ridge purlin and is oriented according to the largest direction of the cross section of said purlin, that is to say parallel to axis A5. The lug is also dimensioned to engage by sliding vertically, as shown in FIG. 11, into a bush 25 rigidly linked to the ridge part 20 and whose axis A7 is vertical when the structure is erected. The fixed bush 25 may be made of one piece with the ridge part 20. Thus when the lug 46 is slotted into the bush 25, on the one hand the ridge purlin rigidly connects the two ridge parts 10, 20, and on the other hand said slotting together prevents the ridge purlin from pivoting according to its longitudinal axis, thereby maintaining it in the optimum position for the strength of the structure.

In addition, the fixed bush 25 has a centering stud 251, extending orthogonally to axis A7 and in the general plane of the ridge part 20 and with dimensions that allow it to engage in a hole 611 provided to this effect in the swivel pin 61, when the structure is folded away, the ridge parts 10 and 20 being positioned one against the other, as shown in FIG. 1. Thus, during the first stage of unfolding the structure, illustrated by FIG. 2, the different ridge parts remain positioned in alignment, avoiding them moving over each other, which could otherwise cause the different components of the structure to move respectively in an uncontrolled way. Thanks to this system of centering the different ridge parts, the deployment and erection of the structure is notably facilitated. In a quite equivalent way, the centering stud could be formed on the swivel pin 61, cooperating with a hole provided in the fixed bush.

The structure is erected as follows: starting from the folded position of the structure shown in FIG. 1, we begin by deploying the rafters 11, 12, 21, 22 by pivoting them on the ridge parts 10, 20, in the directions F1, until the rafters are brought up against the stops 101, 201, in the position shown in FIG. 2, the ridge parts then being held in place in relation to each other by the studs 251 engaged in the holes 611.

We continue to deploy the structure by opening the arches 1, 2, as shown by the arrows F2 in FIG. 3. This opening movement is accompanied by the pivoting, in directions F3, of the profiled sections 51, 52 constituting the eave purlins 5, until said sections are in alignment, this alignment being achieved furthermore by said sections coming up against the stops 531 in the linking parts 53. The latches 54 are then slid in direction F4 until the profiled sections 51, 52 are held together in said aligned position.

The ridge purlin 4, which until now was still in its position up against a rafter, is deployed by pivoting it around axis A5, in direction F5, and by pivoting it on itself around axis A6 in direction F6, to bring the ridge purlin perpendicular to the plane of arch 1, its cross section extending vertically. The ridge purlin is extended by relatively sliding the profiled sections 41, 42 that constitute it, in direction F7, until these sections are locked into the extended position of the ridge purlin, whose second end is then connected to the ridge part 20 of the second arch by engaging the lug 46 in the bush 25.

Figure 13:
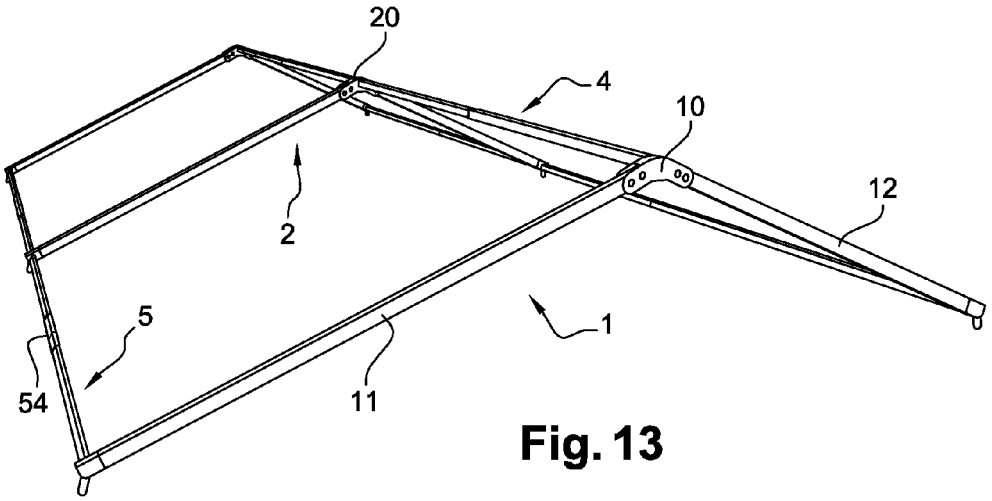
FIG. 13 shows the structure after complete deployment of the eave purlins and the ridge purlin.
Figure 14:
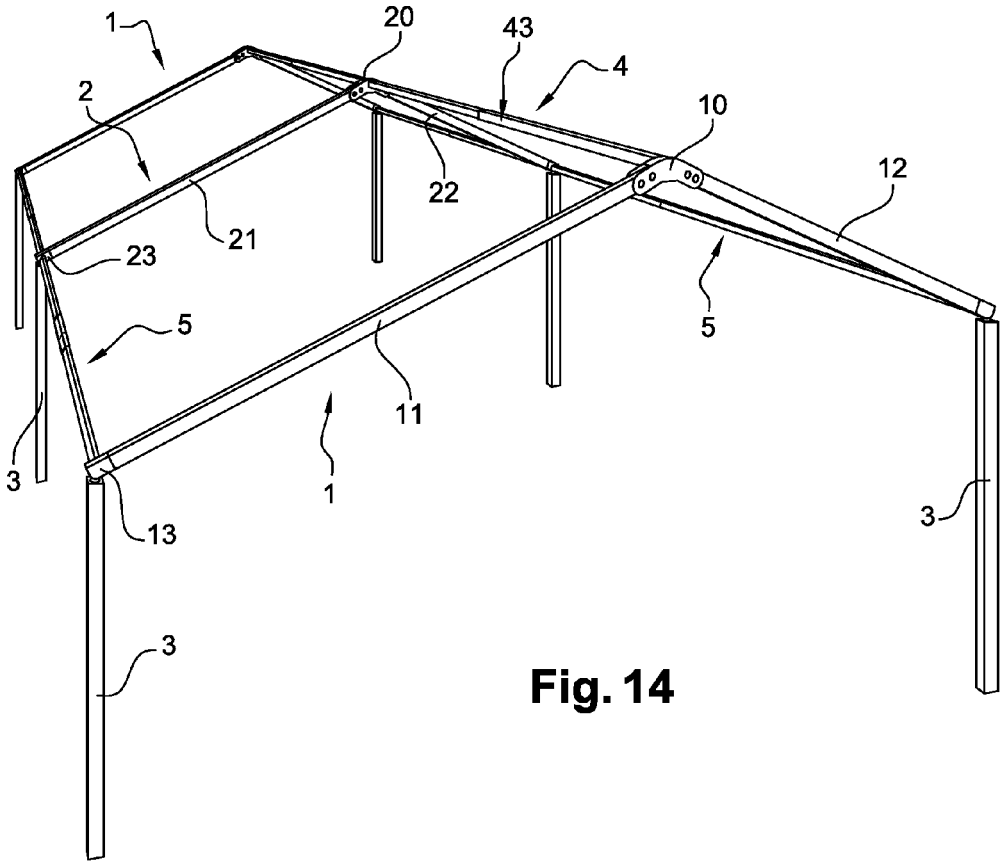
FIG. 14 shows the complete structure, with its legs, ready to receive the tent canvas.

The structure in now in the state illustrated in FIG. 13. If the rafters are also telescopic, then we now bring them into their extended position, then we connect the legs 3 onto the angle parts 13 and 23 to complete the erection of the structure, which is now ready to receive the tent canvas.

Folding the structure away, of course takes place by carrying out the operations in reverse order.

The structure in the example that has just been described has three arches, but of course the same system can be used for structures with two arches or with more than three arches.

Intermediate secondary purlins could also be used to reinforce the support provided for the canvas, located between the ridge purlin and the eave purlins.

In similar structures, it is also possible to make the purlins other than the ridge purlin, or at least some of the other purlins, in a similar way to what has been described for the ridge purlin.

The rafters 11, 12, 21, 22, can also be telescopic, to increase the width of the structure, whilst still having a folded structure with a small volume. In this case, it will also be possible to use as means of locking for the rafters in the deployed position, and in the retracted position, pin-type locking devices similar to the locking device 43 used on the ridge purlin, or other locking devices of known types used to lock sliding telescopic members in position.

Although preferentially the profiled sections used have a rectangular cross section, which is generally optimal for reasons of mechanical strength, it is also possible to use sections with a different cross section, as long as, for the telescopic members at least, they are able to slide one inside the other without any relative rotation according to their longitudinal axis.

The invention claimed is:

1. A foldable modular structure for a fast-erecting tent or similar shelter, consisting of the assembly of profiled sections, generally of the tubular type, configured to support a canvas, said profiled sections forming, in particular, at least two opposing arches linked by at least two purlins, including one ridge purlin wherein a first end of said ridge purlin is linked by a hinge to a first ridge part on a first of said arches, said hinge comprising:

a first pivoting means allowing said ridge purlin to pivot according to a transverse axis, parallel to the plane of the arch, configured to allow the purlin to fold parallel to said arch, a second pivoting means configured to allow the ridge purlin to pivot according to an axis perpendicular to the plane of the arch, and the second end of the ridge purlin comprises linking means for linking with a second ridge part on a second of said arches, said linking means configured to provide a rigid link, but which is dismountable, between the ridge purlin and said second ridge part, wherein the linking means comprise a fixed bush linked rigidly to the second ridge part and having a vertical axis, and a lug integral with the second end of the ridge purlin, extending perpendicular to the longitudinal direction of the ridge purlin and configured to engage slidingly downwards into said bush.

2. The structure according to claim 1, wherein the ridge purlin is telescopic.

3. The structure according to claim 2, wherein the ridge purlin comprises two tubular sections sliding one inside the other, and locking means configured to lock said sliding sections one onto the other.

4. The structure according to claim 1, wherein the hinge connecting the ridge purlin to the first ridge part comprises a clevis, integral with the end of the ridge purlin, pivotably mounted on an intermediate swivel pin according to the transverse axis parallel to the plane of the arch, the intermediate swivel pin being pivotably mounted on the first ridge part according to the axis perpendicular to the plane of the arch.

5. The Structure according to claim 1, wherein the fixed bush is made of one piece with the second ridge part.

6. The structure according to claim 1, wherein the ridge parts comprise means of centering said ridge parts one with the other and configured to maintain said ridge parts in their relative position when the structure is folded away.

7. The structure according to claim 6, wherein the centering means comprise a centering stud on at least one of the fixed bush and on the swivel pin extending orthogonally to the general plane of the ridge part, and with dimensions that allow the centering means to engage in a hole provided in at least one of the swivel pin and the fixed bush.

8. The structure according to claim 1, wherein each of the arches consists of a ridge part and two rafters attached to said ridge part according to different axes and perpendicular to the plane of the arch, the pivoting of the rafters being limited by stops provided in said ridge part.

9. The structure according to claim 8, wherein the rafters are telescopic.

10. The structure according to claim 1, wherein the secondary purlin or purlins that link the two arches together in addition to the ridge purlin, comprise two profiled sections pivotably attached on one hand to each other and on the other hand to their respective arches, according to parallel axes of rotation, configured to allow one of said sections to be folded onto the other.

11. The structure according to claim 10, wherein the axes of rotation of the profiled sections are perpendicular to the general direction of the rafters forming the arches.

12. The structure according to claim 10, wherein the joint linking the two profiled sections forming a purlin comprises blocking means configured to keep the two sections aligned after deployment, said blocking means comprising a tubular latch arranged to slide over said sections and configured to cover the joint and the ends of the two sections adjacent to said joint.

13. A foldable modular structure for a fast-erecting tent or similar shelter, consisting of the assembly of profiled sections, generally of the tubular type, configured to support a canvas, said profiled sections forming, in particular, at least two opposing arches linked by at least two purlins, including one ridge purlin wherein a first end of said ridge purlin is linked by a hinge to a first ridge part on a first of said arches, said hinge comprising:

a first pivoting means allowing said ridge purlin to pivot according to a transverse axis, parallel to the plane of the arch, configured to allow the purlin to fold parallel to said arch, a second pivoting means configured to allow the ridge purlin to pivot according to an axis perpendicular to the plane of the arch, and the second end of the ridge purlin comprises linking means for linking with a second ridge part on a second of said arches, said linking means configured to provide a rigid link, but which is dismountable, between the ridge purlin and said second ridge part, wherein said linking means comprise a fixed bush linked rigidly to the second ridge part and having a vertical axis, and a lug integral with the second end of the ridge purlin, extending perpendicular to the longitudinal direction of the ridge purlin and configured to engage slidingly downwards into said bush.

* * * * *